US010295267B2

(12) United States Patent
Barwig et al.

(10) Patent No.: US 10,295,267 B2
(45) Date of Patent: May 21, 2019

(54) HEAT EXCHANGER

(71) Applicant: MAHLE INTERNATIONAL GMBH, Stuttgart (DE)

(72) Inventors: Jürgen Barwig, Vaihingen/Enz (DE); Steffen Ensminger, Notzingen (DE); Spasoje Ignjatovic, Illingen (DE); Ulrich Maucher, Korntal-Münchingen (DE)

(73) Assignee: MAHLE INTERNATIONAL GMBH, Stuttgart (DE)

( * ) Notice: Subject to any disclaimer, the term of this patent is extended or adjusted under 35 U.S.C. 154(b) by 162 days.

(21) Appl. No.: 14/650,973

(22) PCT Filed: Dec. 5, 2013

(86) PCT No.: PCT/EP2013/075669
§ 371 (c)(1),
(2) Date: Jun. 10, 2015

(87) PCT Pub. No.: WO2014/090683
PCT Pub. Date: Jun. 19, 2014

(65) Prior Publication Data

US 2017/0016679 A1 Jan. 19, 2017

(30) Foreign Application Priority Data

Dec. 10, 2012 (DE) ..... 10 2012 222 638

(51) Int. Cl.
*F28F 9/02* (2006.01)
*F28D 7/16* (2006.01)
(Continued)

(52) U.S. Cl.
CPC ..... *F28D 7/1684* (2013.01); *F28D 9/0025* (2013.01); *F28D 9/0031* (2013.01);
(Continued)

(58) Field of Classification Search
CPC .... F28D 7/1684; F28D 9/0025; F28D 9/0031; F28D 9/0081; F28D 7/16; F28D 7/163;
(Continued)

(56) References Cited

U.S. PATENT DOCUMENTS 3,191,674 A * 6/1965 Richardson ..... F28D 7/06 165/158
7,796,399 B2 * 9/2010 Clayton ..... H05K 1/189 174/257
(Continued)

FOREIGN PATENT DOCUMENTS

BE 438 312 A 4/1940
DE 1 860 641 U 10/1962
(Continued)

OTHER PUBLICATIONS

International Search Report, PCT/EP2013/075669, dated Feb. 17, 2014, 3 pgs.
(Continued)

*Primary Examiner* — Keith Raymond
*Assistant Examiner* — Kamran Tavakoldavani
(74) *Attorney, Agent, or Firm* — Paul D. Strain, Esq.; Strain & Strain PLLC

(57) ABSTRACT

The invention relates to a heat exchanger comprising a block of first and second flow channels arranged adjacently to one another, said block being designed to be open at one inflow side and at one outflow side of the first flow channels for the inflow and outflow of a first fluid into or out of said first flow channels, and the second flow channels comprising openings for the inflow and outflow of a second fluid, said block consisting of a first element and a second element, each of these forming second flow channels and a side wall, and these elements being joined together such that the two side walls form block side walls which lie opposite one another,
(Continued)

said second flow channels extending between these side walls and forming first flow channels between themselves and the side walls.

13 Claims, 6 Drawing Sheets

(51) Int. Cl.
*F28D 9/00* (2006.01)
*F28D 21/00* (2006.01)

(52) U.S. Cl.
CPC ..... *F28D 9/0081* (2013.01); *F28D 21/0003* (2013.01); *F28F 9/02* (2013.01); *F28D 2021/0082* (2013.01); *F28F 2009/029* (2013.01)

(58) Field of Classification Search
CPC ..... F28D 9/00; F28D 7/1607; F28D 7/1692; F28D 21/0003; F28F 3/00
See application file for complete search history.

(56) References Cited

U.S. PATENT DOCUMENTS 9,335,099 B2 * 5/2016 Garret ..... F28D 9/0043
2003/0000687 A1 * 1/2003 Mathur ..... F28D 9/0037 165/166
2003/0075308 A1 * 4/2003 Abiko ..... F28D 9/0068 165/148
2003/0093900 A1 5/2003 Huguet et al.
2009/0013678 A1 * 1/2009 Capelle ..... F28D 7/06 60/320
2009/0297758 A1 * 12/2009 de Groot ..... B29C 44/5636 428/71
2010/0025023 A1 * 2/2010 Schmidt ..... F28D 7/0066 165/157
2010/0243220 A1 * 9/2010 Geskes ..... F02B 29/0418 165/133
2013/0081794 A1 * 4/2013 Tuchowski ..... F28D 9/00 165/165

FOREIGN PATENT DOCUMENTS

DE 32 26 984 A1 7/1983
DE 36 39 328 A1 5/1988
DE 199 27 607 A1 12/2000
DE 10 2011 016 122 A1 11/2011
DE 10 2011 077 154 A1 11/2012

OTHER PUBLICATIONS

German Search Report, Appl. No. 10 2012 222 638.9, dated Apr. 16, 2015, 7 pgs.

* cited by examiner

HEAT EXCHANGER

CROSS-REFERENCE TO RELATED PATNET APPLICATIONS

This application is a National Stage of International Application No. PCT/EP2013/075669, filed Dec. 5, 2013, which is based upon and claims the benefit of priority from prior German Patent Application No. 10 2012 222 638.9, filed on Dec. 10, 2012, the entire contents of all of which are incorporated herein reference in their entirety.

TECHNICAL FIELD

The invention relates to a heat exchanger having a block of first and second flow ducts which are arranged adjacent to one another, wherein the block is designed to be open at an inflow side and at an outflow side of the first flow ducts for the inflow and outflow of a first fluid into and out of the first flow ducts, wherein the second flow ducts have openings for the inflow and outflow of a second fluid, in particular as per the preamble of claim 1.

PRIOR ART

Heat exchangers of the above type are known in the prior art for example for exhaust-gas coolers or charge-air coolers. In this case, exhaust gas or charge air, respectively, is used as first fluid, wherein a liquid coolant is used as second fluid. Here, the alternating arrangement of the first and second flow ducts effects expedient cooling of the first fluid.

Heat exchangers of said type are known for example as disk-type heat exchangers or as stacked-disk heat exchangers. In the case of disk-type heat exchangers, pairs of disks are connected to form first fluid ducts, wherein a multiplicity of disk pairs lined up together form, between them, the second fluid ducts. In the case of stacked-disk heat exchangers, identical disks are stacked one on top of the other, with first and second fluid ducts being arranged alternately between the disks.

A disadvantage of the disk-type or stacked-disk concepts is the cutting waste produced during the production of the disks.

In the case of heat exchangers of tube bundle type of construction, having a tube bundle in which the tubes of the tube bundle are welded into tube plates, the outlay in terms of assembly is relatively high.

PRESENTATION OF THE INVENTION, PROBLEM, SOLUTION, ADVANTAGES

It is therefore the object of the present invention to provide a heat exchanger as discussed above which can be constructed easily and with reduced usage of material.

The problem addressed by the present invention is solved by means of a heat exchanger having the features as per claim 1.

An exemplary embodiment of the invention relates to a heat exchanger having a block of first and second flow ducts, wherein the block is designed to be open at an inflow side and at an outflow side of the first flow ducts for the inflow and outflow of a first fluid into and out of the first flow ducts, wherein the second flow ducts have openings for the inflow and outflow of a second fluid, characterized in that the block is composed of a first element and of a second element, the first and the second element each form second flow ducts and a side wall, wherein the elements are joined together such that the two side walls form opposite side walls of the block and the second flow ducts extend between the side walls and form first flow ducts between themselves and the side walls. It is achieved in this way that the provided number of second flow ducts, together with the two side walls, form the block, and the first flow ducts are received between the two second flow ducts. It is also preferably the case that two second flow ducts form the remaining side walls of the block, such that said block is surrounded by a wall on four sides. Said two flow ducts are preferably two second flow ducts situated at the outside. In this way, the entire block is formed by two elements. It may furthermore also be expedient for turbulence-generating inserts also to be placed into the flow ducts.

It is also advantageous if the second flow ducts and the side wall of an element are manufactured from one part by stamping and folding. In this case, the element is manufactured, stamped and folded for example from a material strip, such that, between two layers of the material strip, a flow duct the fluid of the first flow duct can flow. The multiplicity of second flow ducts can be formed by way of an encircling embossment and a subsequently produced brazed connection or other seal.

It is furthermore expedient if the second flow ducts and the side wall of an element are of comb-like configuration. In this way, a side wall and second flow ducts projecting therefrom can be formed in a straightforward manner.

It is also expedient if the second flow ducts of one element engage between the second flow ducts of the other element. In this way, it is achieved that the two side walls are situated opposite one another and the second flow ducts are oriented parallel to one another.

It is also expedient if the second flow ducts of one element are supported on the side wall of the respective other element. In this way, sealing of the first flow ducts is achieved, as these are arranged between the second flow ducts.

It is furthermore expedient if the side wall of an element has at least one abutment region, or abutment regions, which serve for the abutment of at least one end region, or end regions, of the second flow ducts. Said abutment regions serve for support and secure location before the connection or brazing process, such that a defined position can be realized.

It is furthermore expedient if a second flow duct has an inflow and/or outflow opening in a region of its fold. Thus, the flow duct may be stamped in the region of the fold in order to realize an inflow or outflow through the opening thus formed.

It is also expedient if a second flow duct has an inflow and/or outflow opening in an end region. It can be achieved in this way that the second flow duct can be supplied with the fluid from the same side as the other second flow ducts which project from the other side wall. It is thus not necessary to provide collecting tanks on both sides. A simple configuration can be realized in this way.

It is particularly expedient if a side wall has openings in the abutment region adjacent to openings in the end region of the second flow duct. A supply can thus be provided to the openings in the end regions.

It is also expedient if the openings for the inflow and/or outflow of a fluid into or out of the second flow ducts are arranged on a side wall of the block.

It is furthermore expedient if the openings for the inflow of a fluid into the second flow ducts are equipped with a manifold with a fluid inlet, and the openings for the outflow of a fluid out of the second flow ducts are equipped with a manifold with a fluid outlet.

It is particularly advantageous if the block is equipped, on its inflow side and/or on its outflow side of the first flow ducts, with a manifold with an inflow and/or outflow opening.

Advantageous refinements of the present invention are described in the subclaims and in the following description of the figures.

BRIEF DESCRIPTION OF THE DRAWINGS

Below, the invention will be discussed in more detail on the basis of an exemplary embodiment and with reference to a drawing, in which.

PREFERRED EMBODIMENT OF THE INVENTION

Figure 1:
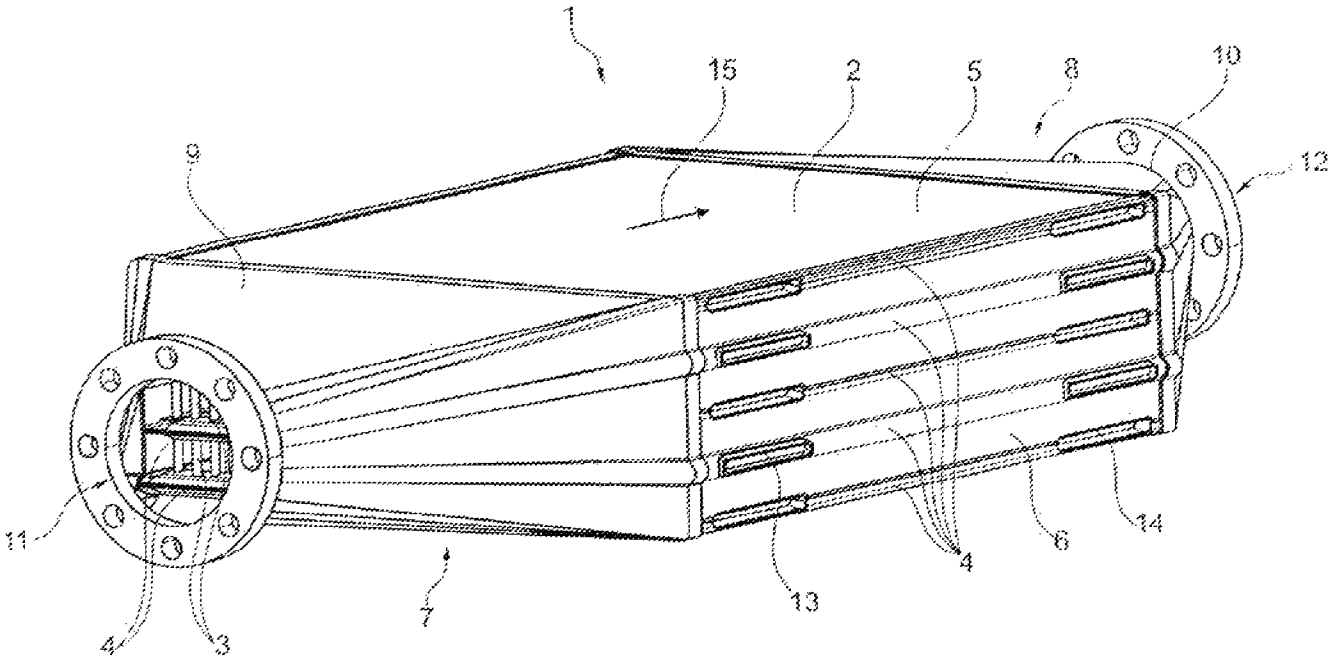
FIG. 1 shows a schematic view of a heat exchanger according to the invention having a block of first and second flow ducts and having an inlet and outlet for a first fluid.

FIG. 1 shows a heat exchanger 1 having a block 2, wherein the block 2 has first flow ducts 3 and second flow ducts 4. The block 2 is delimited to the outside by side walls 5, 6, and, at the two face sides 7, 8 at which the first flow ducts 3 are open for an admission of flow, has manifolds 9, 10 which are equipped with inflow and outflow openings 11, 12.

A first fluid can enter the manifold 9 through the inflow opening 11, can subsequently pass through the first flow ducts 3, and can exit the heat exchanger 1 via the manifold 10 and the outlet opening 12.

Here, the face side 7 forms an inflow side of the first flow ducts 3 of the block 2, wherein the face side 8 forms the outflow side of the first flow ducts 3 of the block 2. At the inflow side and at the outflow side, the first flow ducts 3 are designed to be open for the inflow and outflow of a first fluid into the first flow ducts 3 and out of the first flow ducts 3.

It can also be seen in FIG. 1 that the second flow ducts 4 are equipped, on a side wall 6, with openings 13, 14 which serve for the inflow and outflow of a second fluid into the second flow ducts 4 and out of the second flow ducts 4.

The openings 13, 14, as inflow openings and outflow openings, are arranged one above the other as viewed in a direction perpendicular to the flow direction 15 of the first fluid. Here, the openings 13 are arranged at an end region of the second flow ducts 4 adjacent to the inlet for the first fluid, wherein the openings 14 are arranged in the end region of the second flow ducts 4 adjacent to the outlet for the first fluid. If the second fluid is caused to flow in a countercurrent configuration with respect to the first fluid through the heat exchanger, the openings 14 constitute the inflow opening and the openings 13 constitute the outflow openings. In the case of a co-directional throughflow configuration, the openings would be reversed.

Figure 2:
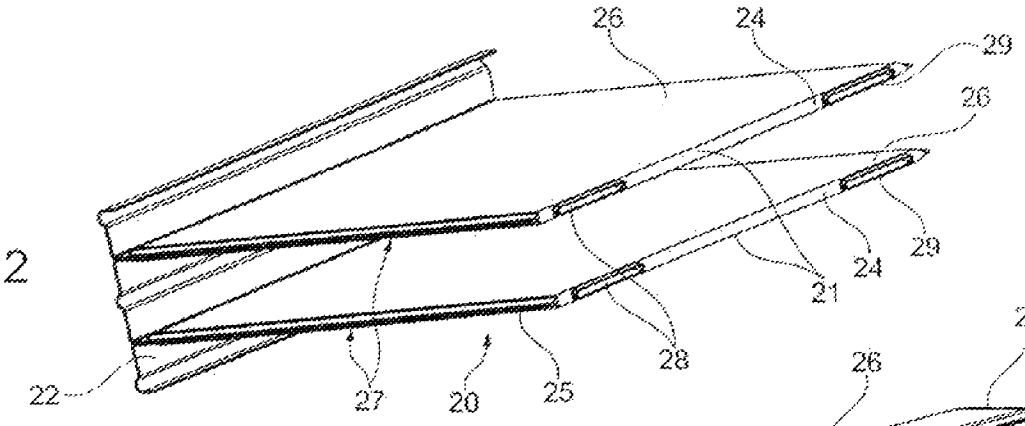
FIG. 2 shows a first element for forming the block of first and second flow ducts, in a perspective illustration.
Figure 3:
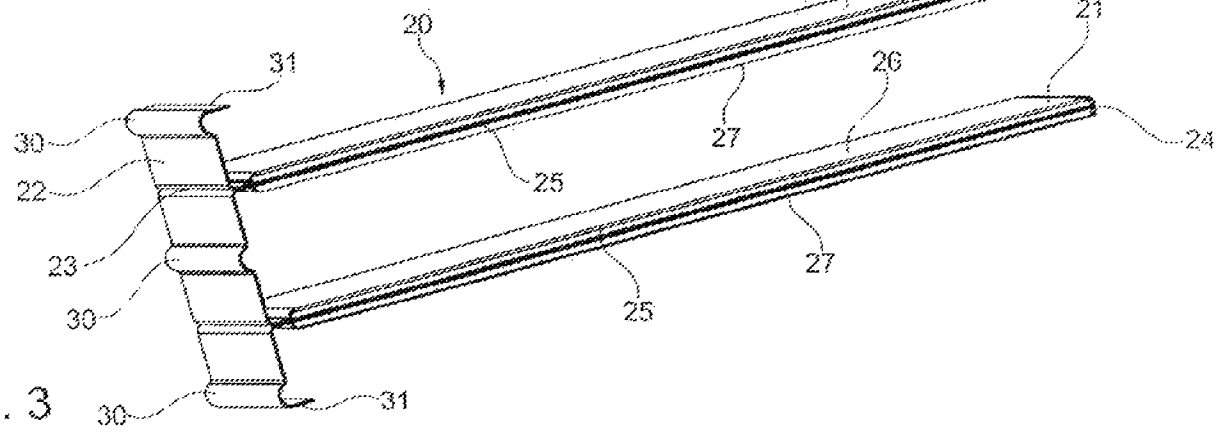
FIG. 3 shows a first element for forming the block of first and second flow ducts in a perspective illustration.

FIGS. 2 and 3 show, in a perspective illustration, a first element 20 which has second flow ducts 21 and a side wall 22.

The first element 20 is formed from a material strip, said first element having been produced by stamping and folding. The second flow ducts 21 are of double-walled form and are formed by folds in the region of the side wall 22 at 23 and at the end regions 24 of the second flow ducts. The second flow ducts 21 have, at the edge, an embossment 25 such that the top side 26 can be connected at the edge to the underside 27 of the flow duct in order to produce a flow volume within the second flow duct 21. At the end regions 24, the second flow ducts 21 are equipped with the openings 28, 29 in order that a second fluid can flow into the second flow duct 21 and can flow out of the second flow duct 21. The side wall 22 has arched regions 30 which serve as abutment regions for the abutment of end regions of second flow ducts 21.

The side walls 22 have, at their end regions, angled ends 31 which serve for the fixing of second flow ducts 21 which project from an opposite side wall to the present side wall.

Figure 4:
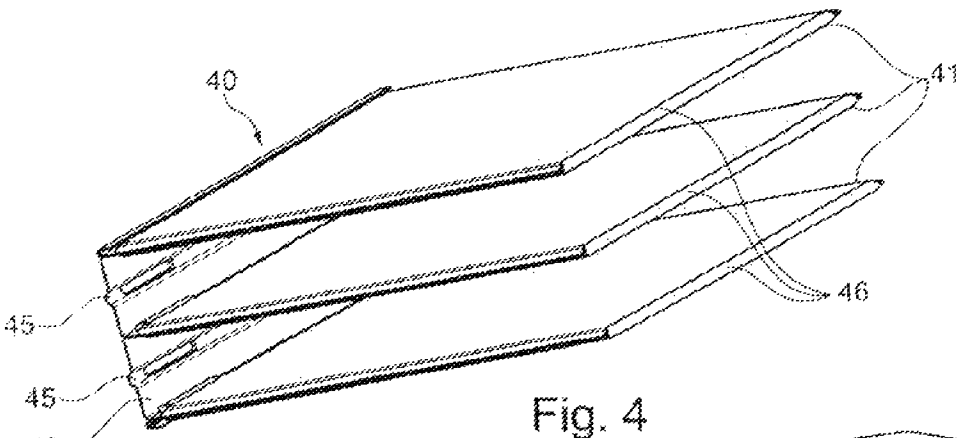
FIG. 4 shows a second element for forming the block of first and second flow ducts in a perspective illustration.
Figure 5:
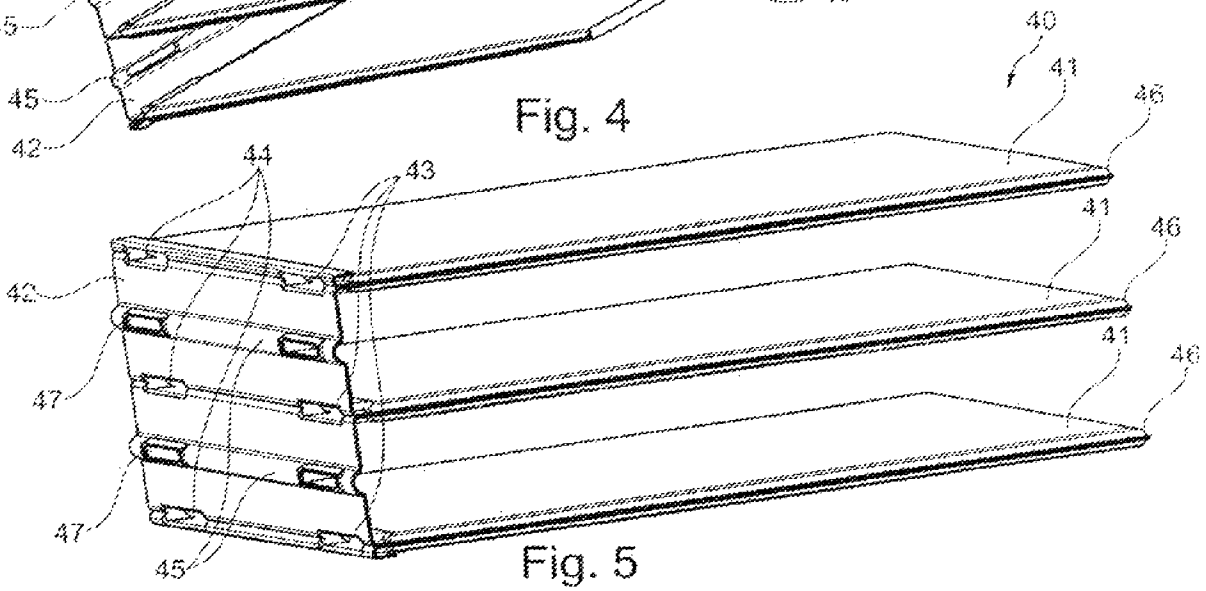
FIG. 5 shows a second element for forming the block of first and second flow ducts in a perspective illustration.

FIGS. 4 and 5 show a second element 40 in a perspective illustration with second flow ducts 41 and a side wall 42. Again, the element 40 is preferably formed from a material strip by stamping and folding, wherein the second flow ducts 41 are, again, of double-walled form with a respective contiguous edge, such that a volume for realizing a throughflow is formed between the edges. The flow ducts 41 project substantially at right angles, and in a comb-like configuration, from the side wall 42, wherein the flow ducts have openings 43 which serve for the inflow into and outflow from the flow duct. Furthermore, the side wall 42 has abutment regions 45 which serve for the abutment of end regions 46 of the second flow ducts. In the exemplary embodiment of FIGS. 4 and 5, the second element has, in the region of the abutment regions 45, openings 47 which serve for the throughflow of second flow ducts which are arranged or affixed in the abutment region 45.

Figure 6:
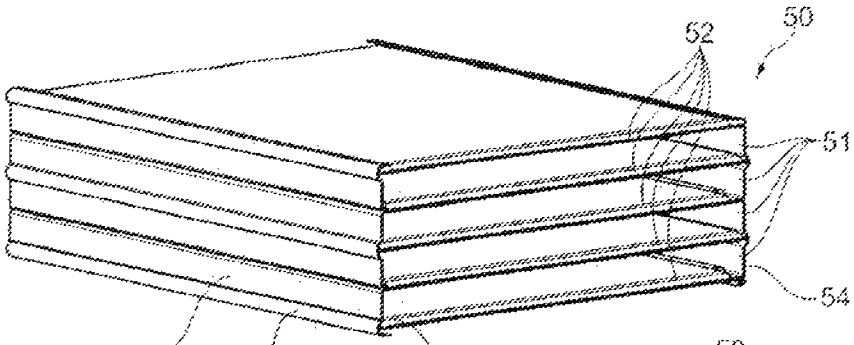
FIG. 6 shows a block of first and second flow ducts in a perspective illustration.
Figure 7:
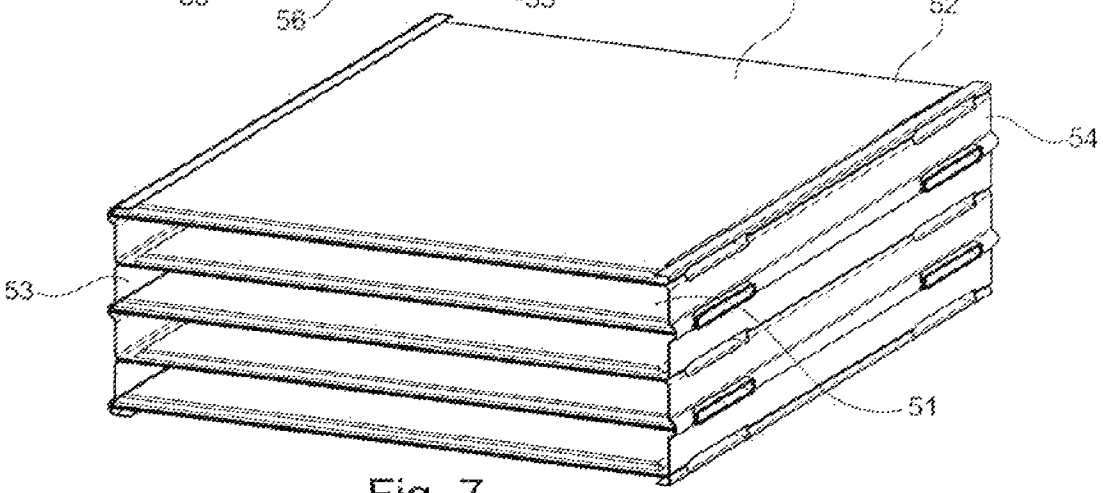
FIG. 7 shows a block of first and second flow ducts in a perspective illustration.

FIGS. 6 and 7 show a block 50 of first flow ducts and second flow ducts 52. The first flow ducts 51 are formed between the second flow ducts 52. The block 50 is composed of a first element 53 and a second element 54 as per FIGS. 2 to 5, which elements are connected to one another such that the two flow ducts 52 of the first element and of the second element 53, 54 are pushed one into the other in alternating fashion, wherein the ends 55 of the flow ducts 52 come to bear against the abutment regions 56 of the side walls 53, 54. The openings 28, 29 in FIGS. 2 and 3 are aligned with openings 47 in FIGS. 4 and 5, so as to permit an inflow into and outflow from those second flow ducts which are supported by way of their end regions against abutment regions and which, in said end regions, have their openings for inflow and outflow.

Figure 8:
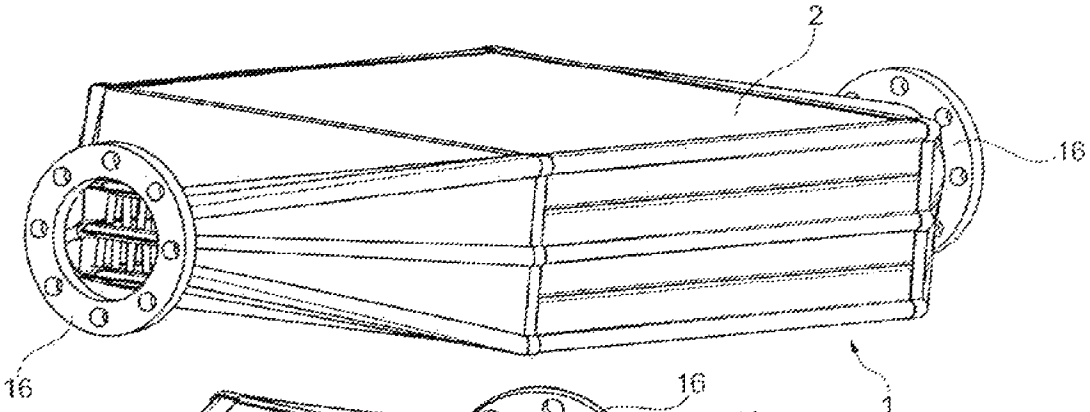
FIG. 8 shows a further schematic view of a heat exchanger according to the invention having a block of first and second flow ducts and having an inlet and outlet for a first fluid.
Figure 9:
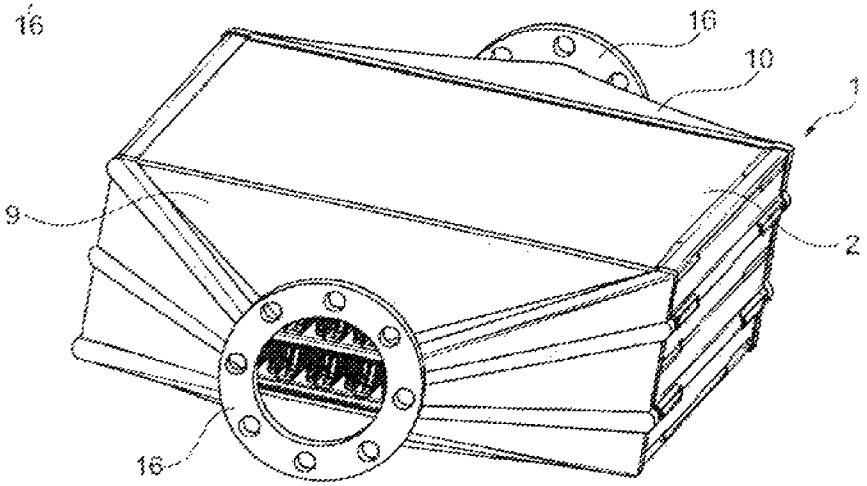
FIG. 9 shows a further schematic view of a heat exchanger according to the invention having a block of first and second flow ducts and having an inlet and outlet for a first fluid.

FIGS. 8 and 9 show the heat exchanger 1 in different perspective illustrations, wherein the block 2 is shown from different sides. The side wall situated opposite the side wall with the openings 13, 14 does not have any openings.

It can also be seen that the manifolds 9, 10 have central inflow and outflow openings 11, 12 which are surrounded by flanges 16 in order that the heat exchanger can be connected to a supply line for exhaust gas or charge air, for example.

Figure 10:
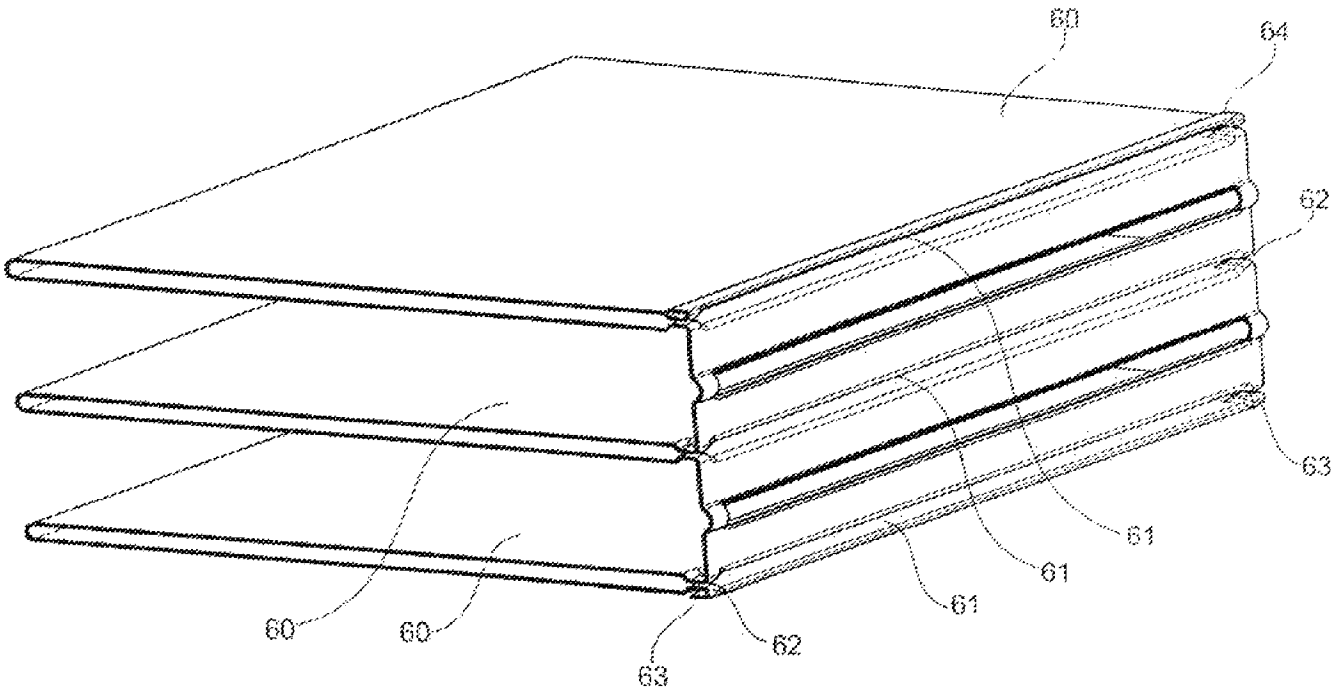
FIG. 10 shows a further element for forming the block of first and second flow ducts in a perspective illustration.

FIG. 10 is an enlarged illustration of an arrangement of second flow ducts 60 with lateral openings 61 for the inflow and outflow of a fluid. In the end regions 62 there are provided embossments 63 for sealing off the flow ducts with respect to one another. No embossment is provided between said edge regions, such that the inlet and outlet openings 61 can be formed. The outer flow ducts have, in this region, a fold 64 in order that the edges of the opening 61 can be defined in a stable manner.

According to the invention, it is particularly advantageous for stamped dimples or beads to be provided in the first and/or second flow ducts for flow guidance purposes. This can advantageously realize improved cooling performance, reduced temperature peaks in regions with poor through-flow, and/or process improvements, owing to support of the wall regions. This is particularly preferable in the case of an embodiment of the heat exchanger for use with a gaseous first fluid and a liquid second fluid, such as for example an exhaust-gas/coolant cooler, such as an indirect charge-air cooler, in which the charge air is cooled by way of liquid coolant.

Furthermore, according to the invention, at least one of the flow ducts may be formed without an inserted turbulence insert. For this purpose, the corresponding flow duct may have a dividing surface, which is of undulating profile, for generating turbulence in the first and/or second fluid ducts. This exemplary embodiment is preferable in the case of the first and second fluid both being liquid, such as is the case for example in an oil/coolant cooler.

As an alternative to this, a turbulence insert may be inserted into the first and/or second fluid duct; in particular, a turbulence insert may be provided in the flow duct for the first fluid. This is preferable in the case of a first fluid being gaseous.

The heat exchanger is preferably in the form of a cross-current flow or countercurrent flow heat exchanger. It is preferably the case that no collecting tanks are provided for the first fluid. This is a preferred structural form for heat exchangers with a large cross section for the first fluid, in particular for a heat exchanger for components in a cooling module in the incident air flow of the vehicle, such as a coolant cooler, oil cooler, air-conditioning condenser etc.

Preferred materials for the heat exchanger are steel or aluminum or an aluminum alloy.

As exemplary embodiments for a manifold for the second fluid, it is possible for said manifold to be equipped with an encircling flanged portion in order to increase the abutment surface and, if appropriate, to achieve an improved brazing result and possibly higher strength. A further alternative is a clasping configuration in which the manifold also engages around the folded matrix at the top and at the bottom.

In the production method, in order to be positioned on other elements of the heat exchanger, the manifold may also be tacked to said other elements, for example by way of tack welding seams.

It is particularly advantageous if both sides are composed of the same, repeating comb-like or loop-like contour, which however differ in terms of different positions of the openings for the first and second fluids. In this case, it is particularly advantageous for the two comb profiles to have an identical structure, wherein said comb profiles may however differ in terms of the number of ducts for second fluid. The flow through the heat exchanger would then be referred to as a Z-shaped flow with an odd number of ducts for the second fluid.

It may also be advantageous for an additional base and cover plate to be provided in order to facilitate positive locking between the manifold for the first fluid and the matrix, and in order to realize an increase in strength.

According to the invention, the heat exchanger may also be formed by way of so-called one-shot brazing, and may be brazed as a whole together with brackets and other peripheral parts.

The invention claimed is:

1. A heat exchanger having a block comprising a plurality of first and second flow ducts, wherein the block further comprises a first inflow opening at an inflow side and a first outflow opening at an outflow side of the plurality of first flow ducts for the inflow and outflow of a first fluid into and out of the plurality of first flow ducts, wherein the block further comprises a first element and a second element, wherein the first and the second element are each formed from a single material strip having a side wall and bounding multiple second flow ducts of the plurality of second flow ducts such that the first element and the second element each have multiple of the plurality of second flow ducts, wherein the plurality of second flow ducts are each fluidically separate from one another inside the block, wherein each second flow duct is bounded on at least two sides by parallel faces of a folded portion of the first or second element, wherein each second flow duct projects perpendicularly from the side wall of the first or second element, wherein each second flow duct is sealed with embossments but has a second inflow opening and a second outflow opening leading into and out of the block, wherein the single material strips of the first element and the second element are physically joined together such that the side walls of the first and second element form opposite block side walls of the block and each of the plurality of second flow ducts of the first and second element extend in a parallel manner between the opposite block side walls, wherein the opposite block side walls and the plurality of second flow ducts bound a first flow duct of the plurality of first flow ducts arranged between the second flow ducts, wherein the plurality of first flow ducts are fluidically separate from the plurality of second flow ducts.

2. The heat exchanger as claimed in claim 1, wherein the first element and the second element each consist of a single part produced by stamping and folding.

3. The heat exchanger as claimed in claim 1, wherein the first element and the second element each comprise the plurality of second flow ducts, wherein the second flow ducts and the side wall are arranged perpendicularly in a comb-like configuration.

4. The heat exchanger as claimed in claim 1, wherein the multiple second flow ducts of one first or second element engage between the second flow ducts of the other first or second element.

5. The heat exchanger as claimed in claim 1, wherein a sealed end region of each second flow duct of the first element projects from the side wall of the first element into an arched region of the side wall of the second element.

6. The heat exchanger as claimed in claim 1, wherein the side wall of the first or second element has a plurality of abutment regions, each abutment region serving for the abutment of at least one sealed end region of one of the multiple second flow ducts of the respective other of the first or second element.

7. The heat exchanger as claimed in claim 6, wherein a second flow duct of the plurality of second flow ducts has an inflow or outflow opening in a region of a fold arranged at a region of the second flow duct connecting to the side wall.

8. The heat exchanger as claimed in claim 6, wherein the second inflow opening or second outflow opening are arranged in an end region opposite the region of a second flow duct of the plurality of second flow ducts connecting to the side wall.

9. The heat exchanger as claimed in claim 8, wherein the side wall has openings in the abutment region adjacent to openings in the end region of the second flow duct.

10. The heat exchanger as claimed in claim 1, wherein the second inflow opening or second outflow opening are arranged on one or both of the opposite block side walls.

11. The heat exchanger as claimed in claim 10, wherein the openings for the inflow of a fluid into the plurality of second flow ducts are equipped with a manifold with a fluid inlet, and the openings for the outflow of a fluid out of the plurality of second flow ducts are equipped with a manifold with a fluid outlet.

12. The heat exchanger as claimed in claim 1, wherein the block further comprises a manifold with an inflow or outflow opening on an inflow side or on an outflow side of the plurality of first flow ducts.

13. A heat exchanger having a block comprising a plurality of first and second flow ducts, wherein the block further comprises a first inflow opening at an inflow side and a first outflow opening at an outflow side of the plurality of first flow ducts for the inflow and outflow of a first fluid into and out of the plurality of first flow ducts, wherein the block further comprises a first element and a second element, wherein the first and the second element are each formed from a single material strip having a side wall and bounding multiple second flow ducts of the plurality of second flow ducts such that the first element and the second element each have multiple of the plurality of second flow ducts, wherein the plurality of second flow ducts are each fluidically separate from one another inside the block, wherein each second flow duct is bounded on at least two sides by parallel faces of a folded portion of the first or second element, wherein each second flow duct projects perpendicularly from the side wall of the first or second element, wherein each second flow duct is sealed with embossments but has a second inflow opening and a second outflow opening leading into and out of the block, wherein the single material strips of the first element and the second element are physically joined together such that the side walls of the first and second element form opposite block side walls of the block and each of the plurality of second flow ducts of the first and second element extend in a parallel manner between the opposite block side walls, wherein the opposite block side walls and the plurality of second flow ducts bound a first flow duct of the plurality of first flow ducts arranged between the second flow ducts, wherein the plurality of first flow ducts are fluidically separate from the plurality of second flow ducts, wherein the first element and the second element each consist of a single part produced by stamping and folding, wherein the first element and the second element each comprise the plurality of second flow ducts, wherein the second flow ducts and the side wall are arranged perpendicularly in a comb-like configuration, wherein the side wall of the first or second element has at least one abutment region, which serves for the abutment of at least one end region of the second flow duct of the respective other of the first or second element, wherein the second flow duct of one first element projects from side wall of the first element to the at least one abutment region which is formed as an arched region of the side wall of the second element, wherein the second flow duct has an inflow or outflow opening in a region of a fold arranged at a region of the second flow duct connecting to the side wall, wherein the side wall has openings in the abutment region adjacent to openings in the end region of the second flow duct, wherein the block further comprises a manifold with an inflow or outflow opening on an inflow side or on an outflow side of the plurality of first flow ducts.

* * * * *